US005152374A

United States Patent [19]

Pokus

[11] Patent Number: 5,152,374

[45] Date of Patent: Oct. 6, 1992

[54] ELEVATOR SYSTEM FOR A BUILDING

[76] Inventor: Ivan Pokus, 162 Edgemont Drive, Winnipeg, Manitoba, Canada, R2J 3H9

[21] Appl. No.: 745,396

[22] Filed: Aug. 15, 1991

[51] Int. Cl.[5] ..... B66B 9/00

[52] U.S. Cl. ..... 187/1 R; 187/15; 187/16; 187/51; 187/54

[58] Field of Search ..... 187/1 R, 15, 16, 20, 187/51, 56, 62, 63, 94; 254/266

[56] References Cited

U.S. PATENT DOCUMENTS

| | | | |
|---|---|---|---|
| 473,036 | 4/1892 | Veenschoten | 187/1 R |
| 780,290 | 1/1905 | Hopkinson . | |
| 1,078,998 | 11/1913 | Ernst | 187/1 R |
| 1,868,878 | 7/1932 | Botnick . | |
| 4,421,209 | 12/1983 | Vermette et al. | 187/9 R |
| 4,921,385 | 5/1990 | Okuno | 187/9 R |

FOREIGN PATENT DOCUMENTS

| | | |
|---|---|---|
| 1242383 | 9/1989 | Japan . |
| 2305785 | 12/1990 | Japan . |

*Primary Examiner*—Joseph E. Valenza
*Assistant Examiner*—Dean A. Reichard
*Attorney, Agent, or Firm*—Adrian D. Battison; Stanley G. Ade; Murray E. Thrift

[57] ABSTRACT

An elevator system for a two storey building includes two carriages each of which is movable from the upper floor to the lower floor and which are mounted in a counterbalance arrangement so as to move simultaneously. The carriages are mounted upon a single central support between the two carriages and are carried thereby in cantilevered arrangement projecting outwardly from the sides of the central support. The whole of the weight of the structure is therefore transmitted to the base of the support to avoid necessity for reinforcement of the building structure. A door system includes four doors, two on each level. The doors are spring biased to an open position that can be latched closed. The latches are automatically opened so that the available carriage always has the door open. Opposed doors on the two levels are connected by lever mechanism so that as the door on the lower level is closed to close the carriage, the door on the upper level is also closed to close the carriage present at that level. This saves time since a carriage is always awaiting the potential occupant on whichever level he approaches.

17 Claims, 3 Drawing Sheets

ELEVATOR SYSTEM FOR A BUILDING

FIELD OF THE INVENTION

This invention relates to an elevator system for a building of the type which includes two floors without any intervening floors which are to be serviced.

BACKGROUND OF THE INVENTION

Elevators are very common for higher buildings of three or four floors generally with a single elevator which is movable from each floor to the next in accordance with demand. Taller buildings generally have more elevators to service the increased number of occupants of the building with the elevators operating independantly except that there may be some programming of the system by which the elevators wait at particular positions when not in use.

Bungalows and single level apartments are very popular because there is no need for the occupants to move from one level to another using a stairway and all of the features of the building are then available on one level.

Further, for attractiveness and building efficiency, single family dwellings have become more often two storey buidings with of course a stairway connecting the two floors. Stairways are of course effective and very quick for the able bodied person but as the occupants become older the stairway often becomes inconvenient and time consuming so that the older occupants often prefer to move to a bungalow or similar single storey dwelling.

There has been very little attention given to the possibility of providing an efficient elevator system for a simple two storey building such as a single family dwelling. Elevator systems for disabled persons are available but generally this operate on the stairway and are very slow and inconvenient so that the able bodied person certainly would not wish to utilize an arrangement of this type.

It is believed that there has been very little attention to such elevator systems for two storey buildings because the system employed is not sufficiently efficient in time to make its adoption worthwhile. Furthermore the elevator system is generally relatively expensive in view of the necessity to reinforce the structure of the building to carry the weight involved in the movement of the carriage.

SUMMARY OF THE INVENTION

It is an object of the present invention, therefore, to provide an improved elevator system for use in a two storey building.

According to a first object of the present invention there is provided a building and elevator system therein comprising a building having a first floor and a second floor arranged directly above the first floor without intervening floors, and an elevator mounted within the building so as to transport occupants from the first floor to the second floor and vice versa, the elevator comprising a first carriage and a second carriage, each carriage being dimensioned to receive at least one erect human occupant, support means mounting each of the first and second carriages for movement only between the first and the second floors, said support means being arranged such that the carriages are counterbalanced so that one carriage is positioned at the first floor while the other is positioned at the second floor and weight of said one carriage as it moves upwardly from the first floor to the second floor is counterbalanced by the weight of the other carriage as it moves downwardly from the second floor to the first floor, means defining on the first floor a first and a second doorway, means defining on the second floor a third and a fourth doorway, the first and third doorways being arranged to allow entry by said occupant into the first carriage when on the first and second floors respectively and the second and fourth doorways being arranged to allow entry by said occupant into the second carriage when on the first and second floors respectively, and first, second, third and fourth door means movable to close each of said doorways respectively and control means for controlling movement of said door means.

Preferably the door control system is arranged to control doors in pairs so that the first and fourth doors operate together to move to the open position simultaneously and the second and third doors operate together to move simultaneously to the open position.

According to a second aspect of the present invention there is provided a cantilever support means for each of the carriages comprising lower roller means arranged between a lower part of the carriage and the central support structure for preventing movement of the lower part of the carriage toward the central support structure and an upper roller means arranged between a part of the carriage above the lower part and the central support structure and arranged to prevent movement of the upper part of the carriage away from the central support structure.

One embodiment of the invention will now be described in conjunction with the accompanying drawings, in which:

DESCRIPTION OF THE DRAWINGS

In the drawings like characters of reference indicate corresponding parts in the different figures.

DETAILED DESCRIPTION

Figure 1:
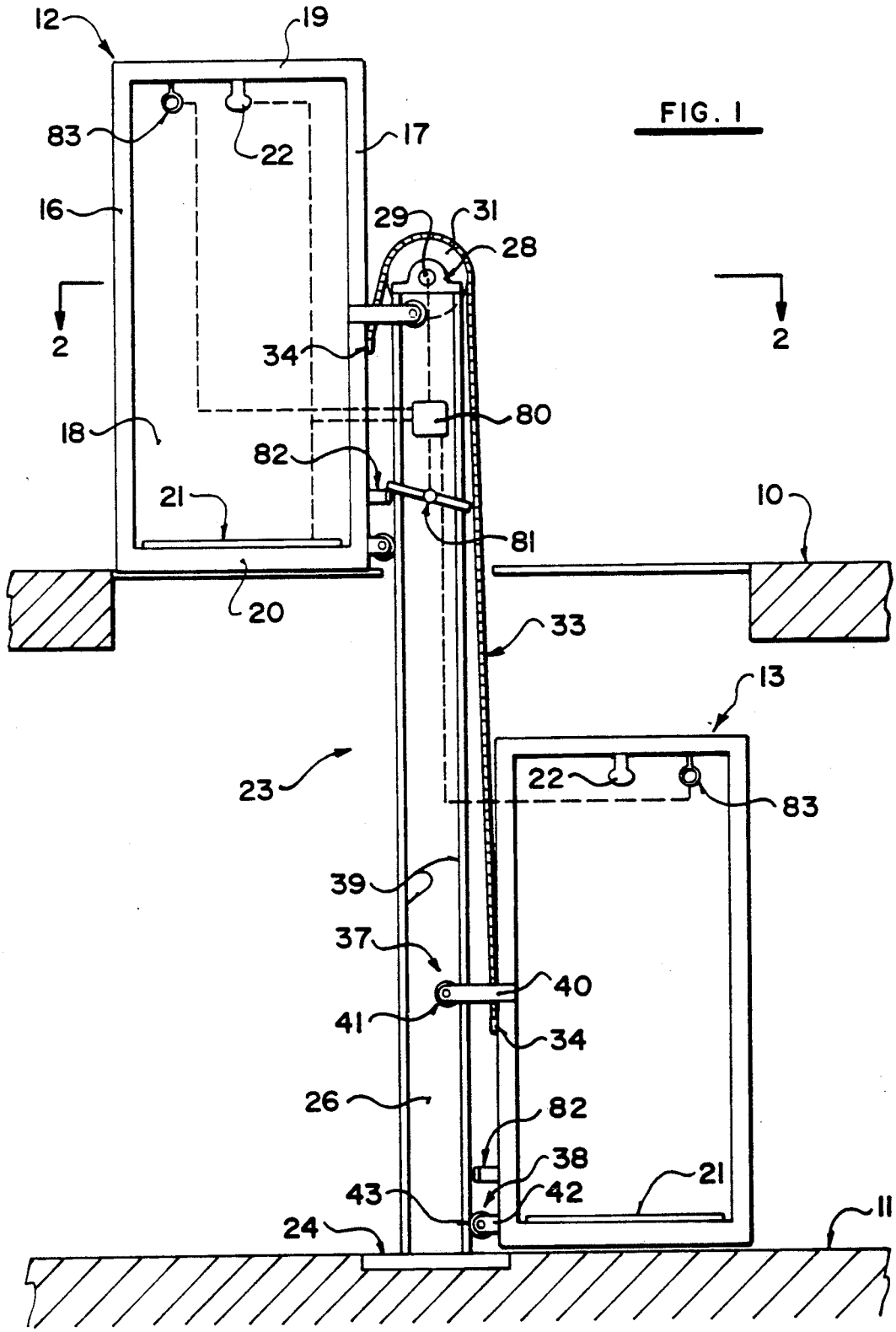
FIG. 1 is a front elevational view of the elevator system in a two storey building with the doors and facing walls removed to show the structure and operation of the carriages and support frame.
Figure 3:
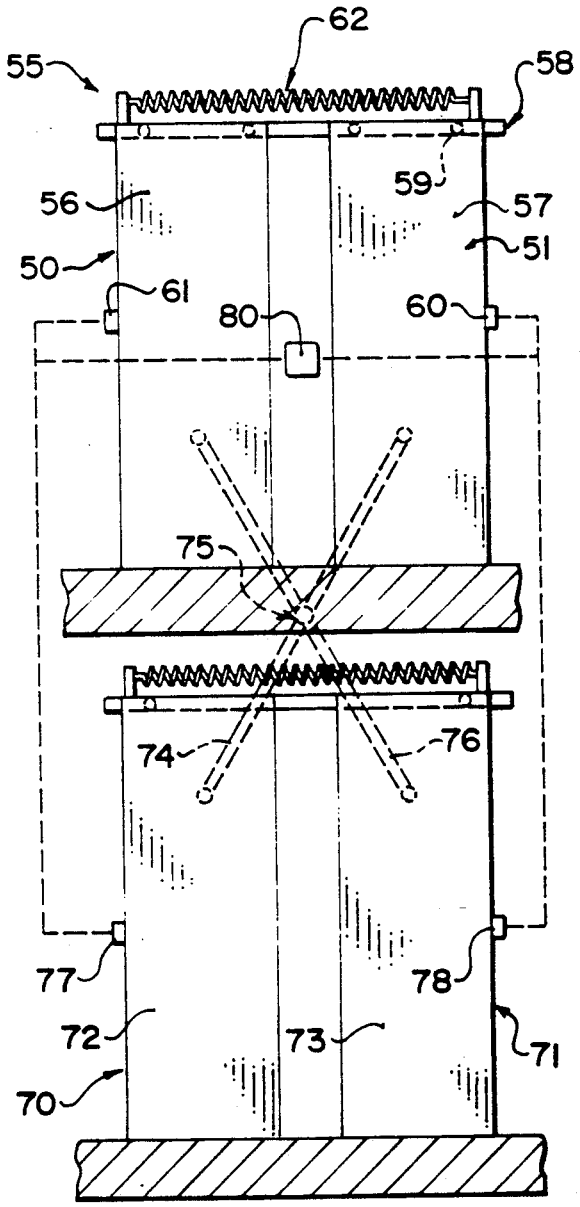
FIG. 3 is a front elevational view similar to that of FIG. 1 showing the doors in a closed position.
Figure 4:
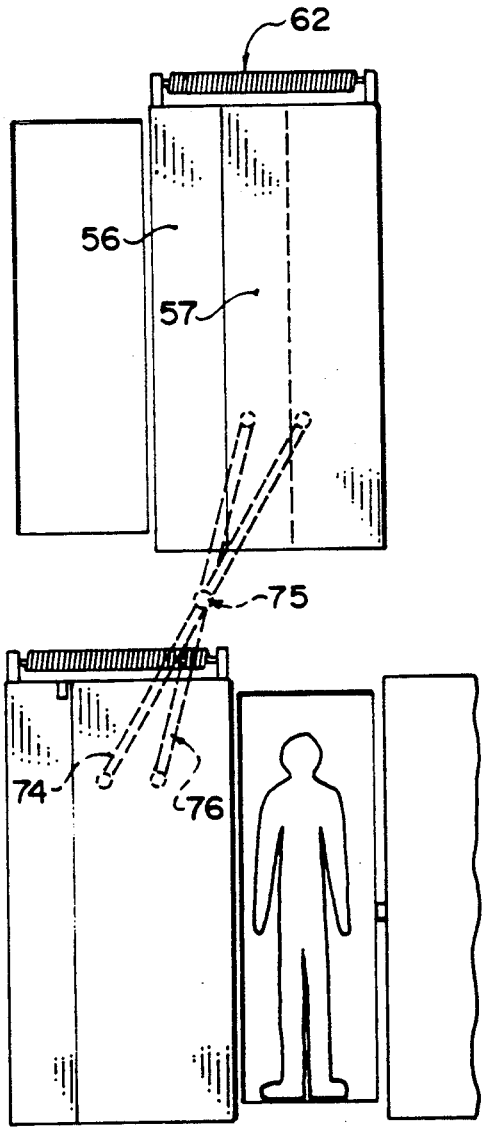
FIG. 4 is a front elevational view similar to that of FIG. 3 showing two of the doors in an open position.

A two storey building is shown in FIGS. 1, 3 and 4 including an upper floor 10 of the upper storey and the lower floor 11 of the lower storey. The floors are arranged directly overlying so that there are no intervening floors as for example in a two storey single family dwelling.

The elevator system includes a first carriage 12 and a second carriage 13 each of which is movable vertically between positions on the first and second floors for example as shown in FIG. 1 the carriage 12 is on the upper floor 10 while the carriage 13 is on the lower floor 11. Each of the carriages comprises basically a rectangular box with a front open face 15, side walls 16 and 17 and a rear wall 18. The walls are shown only schematically but will of course include structural members which enable the box to remain rigid during movement and to support the weight of one or more occupants without distortion. The box further includes an upper panel 19 and a floor panel 20 so the box is substantially closed apart from the open front face 15. At the base of the carriage is provided a pad 21 on which the occupant can stand which includes means for detecting the presence of the occupant. A lamp for illuminating the interior of the carriage is indicated at 22.

Each of the carriages is mounted upon a single central structural element 23 so that the weight of the carriages and the occupants is carried by the structural element 23. The structural element 23 is mounted upon a base 24 mounted upon the lower floor 11 or suitable building support provided thereby so the whole of the weight of the structural element 23 and the carriages and the occupants is transferred vertically to the base 24 without the necessity for any further structural reinforcement of the building.

The support structure 23 comprises a pair of channel members 25 and 26 which are arranged back-to-back and interconnected by braces 27 to form a rigid vertical structure. On top of each of the channel members 25 and 26 is mounted a pillow block bearing 28 receiving a transverse shaft 29 extending directly across the top of the channel members and supported thereby for rotation about the longitudinal axis of the shaft 29. The height of the channel member is arranged so that the shaft 29 is positioned just above the mid-height of the carriage when on the upper floor so that is the shaft 29 is below the top of the carriage. Upon the shaft is mounted a pair of sprockets 30 and 31 which are attached to the shaft for rotation therewith and arranged at spaced positions along the shaft each adjacent respective one of the channel members. The sprocket is of a diameter greater than that of the shaft so that extends outwardly beyond the radius of the shaft to a position closely adjacent the adjacent side wall 17 of the carriage 12 and the adjacent side wall of the carriage 13. Around the sprockets are wrapped a pair of chains 32 and 33 which are looped over the sprockets and have ends clamped at 34 to the side wall of the carriage.

As best shown in FIG. 1, therefore, the carriages are in counterbalance arrangement so that as one moves vertically downwardly from the upper floor to the lower floor the other moves vertically upwardly from the lower floor to the upper floor. The weight is thus counterbalanced so that force necessary for rotation of the shaft is relatively small when the carriages are unoccupied and is limited to the differential in load when one of the carriages occupied and the other is not or when the occupant of one is heavier than that of the other. The shaft 29 is driven by a motor 35 and is braked by a brake disc 36 both of which are shown only schematically.

The carriages are supported in cantilever manner from the central frame structure 23. Specifically each carriage includes an upper roller element 37 and a lower roller element 38 each of which rolls on the flange 39 of the channel member. The upper roller element 37 includes a strap 40 projecting outwardly from the face of the carriage along the open face of the channel member with a roller 41 projecting from the strap 40 into the channel member for running against an inside surface of the flange 39. The strap 40 is positioned approximately at the mid-height of the carriage. The roller element 38 includes a clevis 42 which supports a roller 43 projecting outwardly from the side surface of the carriage into engagement with the outer side of the flange 39. The carriage is thus supported at the front by a front roller set and at the rear by a rear roller set. The rollers prevent the carriage from twisting away from the central support frame.

The structure therefore described above provides an elevator system which is simple and therefore less costly than elevators presently in the market. This is possible because it is suspended from a frame standing upon the lower level and thus no strong structure of the upper level of the building is required. This makes it also possible to install the elevator into an existing house without reinforcement of the building structure. The limited height of the frame structure to a position at or just below of the top of the carriage on the upper floor again makes this structure more simple and avoids in any way interfering with the ceiling or roof trusses of the upper floor.

Figure 2:
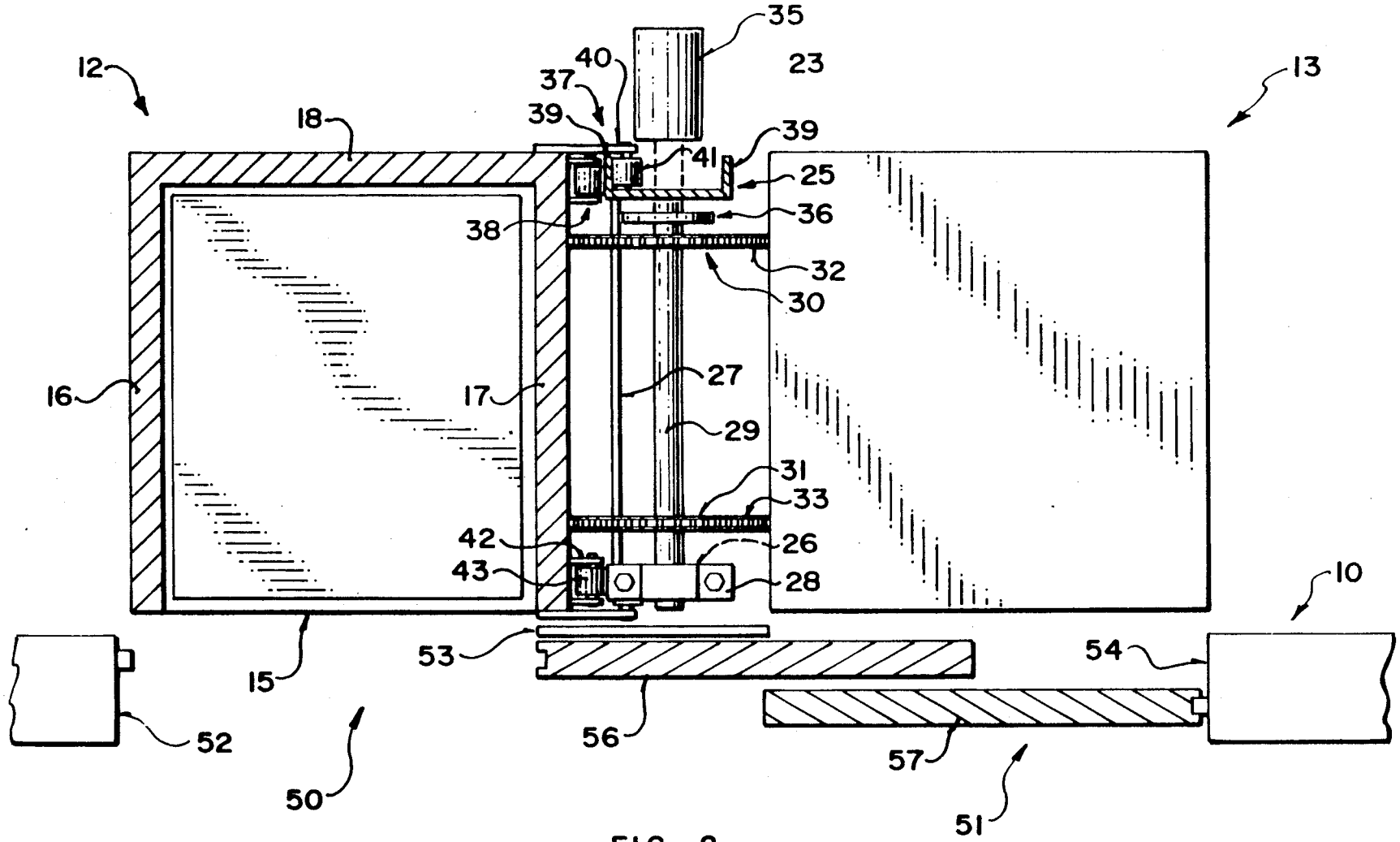
FIG. 2 is a view substantially along the lines 2—2 of FIG. 1 but showing one side of the frame structure in cross section and including the doors and facing panels.

A door system for the open front face of the carriages is illustrated in FIGS. 2, 3 and 4. The door system includes four doorways which are fixed on the floor 10 and 11 so that the doorways and the doors do not move with the carriage but are provided as fixed elements on the floor as approached by the intending occupant.

Each floor therefore includes two doorways indicated in FIG. 2 for the upper floor 10 at first doorway 50 and second doorway 51. The doorway 50 is defined between a front face 52 of the adjacent wall and a thin panel 53 positioned in front of the frame structure and behind the doors. The doorway 51 is defined between the panel 53 and a front face 54 of the adjacent wall. The bottom of the doorway is defined by the floor. The top of the doorway is defined by a header 55.

Each doorway can be opened and closed by a sliding door 56 and 57 respectively. The door 56 can therefore slide sideways from an initial position shown in FIG. 3 covering the doorway 50 to an open position shown in FIGS. 2 and 4 in which the doorway and thus the front face 15 of the carriage is exposed for entry by an occupant.

The door 56 comprises a single panel preferably of a transparent material. For convenience of illustration the panel is shown only schematically but in general this will include a frame and a transparent window for immediate viewing from outside as to whether the carriage is occupied. In the open position shown in FIG. 2, the door moves to a position just to the inner side edge of the doorway 50 but it can also move beyond that position to directly lie behind the door 57.

Similarly the door 57 can move from the closed position shown in FIG. 3 to an open position not shown symmetrical to the position shown in FIGS. 2 and 4 for the door 56.

The doors 56 and 57 are carried on an overhead track system 58 including rollers 59. The door 57 has a latch mechanism 60 positioned at one side of the door and the door 56 has a latch mechanism 61 similarly positioned so that the doors can be latched in the closed position. The doors are spring biased to an open position by a spring 62 coupled between outer edges of the doors so the spring 62 can pull the doors into a position in which the doors are directly overlying. Thus when one door remains latched, the other door when released is spring biased to the open position.

Similarly the lower floor includes doorways 70 and 71 and doors 72 and 73 which operate and move in exactly the same manner as the doors on the upper floor.

Furthermore the door 72 is directly linked to the door 57 by lever mechanism 74 pivotal about a centre pivot point 75 so the doors 57 and 72 necessarily must move in unison.

Similarly the doors 56 and 73 include a lever mechanism 76 again pivotal about the centre pivot point 75 which causes the doors 56 and 73 to move in unison.

The doors 72 and 73 also include latch mechanisms 77 and 78 similar to the latch mechanism 60 and 61 of the doors 56 and 57.

A control unit 80 is connected to the pads 21 of each of the carriages, to the lamps 22, to the latch mechanisms 60, 61, 77 and 78 and to the drive motor 35. A reversing switch 81 is also provided which is engaged by an abutment 82 on each of the carriages. When that carriage reaches the upper position the switch 81 causes movement of the motor to halt and also to reverse the direction of movement of the motor for the next movement cycle. The reversing switch 81 is again connected to the control unit 80.

A manual emergency pull switch 83 is provided in each carriage connected to the control unit 80 to release each of the latches to free the occupants from the carriages if halted by power failure or other failure.

In operation, in an initial position of the elevator system, the carriages will take a position in which one of the carriage is on the upper floor and the other carriage is on the lower floor. When this position is achieved, the switch 81 is actuated and this switch through the control unit 80 acts to halt the motor 35 and also to release the latches 61 and 78 so that the spring force from the springs 62 causes the doors 56 and 73 to move to the open position simultaneously under control of the linkage 76. This position is therefore an initial position in which the system will be approached by a potential occupant.

As the potential occupant approaches, except when the carriage is actually moving, one of the carriages will be presented to the occupant for immediate entry.

As the occupant enters the readily available carriage, the presence of the occupant is detected by the pad 21 thus illuminating the lamp 22 in both of the carriages. This illumination indicates to a person considering entering the carriage on the other floor, unbeknownst to the entering occupant, so that the person approaching the carriage will know that the door is about to close.

The door is then grasped manually by the occupant from its initial position adjacent one side of the doorway and is moved manually to the closed position in which the latch 61 and the latch 78 operate to latch the respective doors and to retain them in the closed position. The movement of one of the doors of course simultaneously moves the other of the doors by way of the linkage 76. The latches are reactivated by the control unit 80 for latching the door upon detection of the presence of the occupant.

When the doors are fully closed, this fact is communicated by the latch mechanism to the control unit so that the motor 35 is started and is turned in the relevant direction under control of the control unit 80 upon detection of the position from the switch 81. The carriage is thus moved from the initial position to the opposite position which again is detected by the switch 81 thus releasing the latch mechanisms on the doors 72 and 57 so those doors simultaneously open under control of the linkage 74 and under the spring bias of the spring 62 while the doors 56 and 73 remain closed to cover the open area from which the carriage has just been removed.

The present elevator system therefore saves significant time in moving a person from one level to the other in comparison with the existing single cabin elevator system. This is done by eliminating the time waiting for the free cabin to relocate to the required level and by eliminating the time needed for opening the door. This is achieved since the system has one cabin always ready to be used at each level at any time (except when actually in movement) and the door of the cabin which is available for use is open at all times. The present system therefore fills the existing gap in otherwise great variety of elevators already in the market by improving the ratio of time saved over the amount of money spent. This poor ratio in two storey dwellings is believed to be the reason why elevators which are so widely used for any number of floors from 3 to over a 100 are virtually non-existant in two storey single family dwellings which are the most frequently available types of buildings.

Since various modifications can be made in my invention as hereinabove described, and many apparently widely different embodiments of same made within the spirit and scope, it is intended that all matter contained in the accompanying specification shall be interpreted as illustrative only and not in a limiting sense.

I claim:

1. A building and elevator system therein comprising a building having a first floor and a second floor arranged directly above the first floor without intervening floors, and an elevator mounted within the building so as to transport occupants from the first floor to the second floor and vice versa, the elevator comprising a first carriage and a second carriage, each carriage being dimensioned to receive at least one erect human occupant, support means mounting each of the first and second carriages for movement only between the first and the second floors, said support means being arranged such that the carriages are counterbalanced so that one carriage is positioned at the first floor while the other is positioned at the second floor and weight of said one carriage as it moves upwardly from the first floor to the second floor is counterbalanced by the weight of the other carriage as it moves downwardly from the second floor to the first floor, means defining on the first floor a third and a fourth doorway, the first and third doorways being arranged to allow entry by said occupant into the first carriage when on the first and second floors respectively and the second and fourth doorways being arranged to allow entry by said occupant into the second carriage when on the first and second floors respectively, first, second, third and fourth door means movable to close each of said doorways respectively and control means for controlling movement of said door means arranged to provide simultaneous operation of the first and fourth door means and to provide simultaneous operation of the second and third door means such that movement of one of the first and fourth door means to the open position causes simultaneous movement of the other of the first and fourth door means to the open position and such that movement of one of the second and third door means to the open position causes simultaneous movement of the other of the second and third door means to the open position.

2. The system according to claim 1 wherein the control means includes a first and a second mechanical lever linkage, the first mechanical lever linkage being connected between the first and fourth door means and the second mechanical lever linkage being connected between the second and third door means.

3. The system according to claim 1 including means biassing the door means to an open position thereof and means for latching each of the door means in a closed position, said latching means arranged to hold the respective door means in the closed position except when the associated carriage is positioned at the respective doorway.

4. The system according to claim 3 including means responsive to closing of the door means to actuate movement of the carriages.

5. The system according to claim 3 wherein said latch means is arranged to automatically release the door means for movement to the open position thereof when the carriage receives the doorway associated with the door means.

6. The system according to claim 1 including means responsive to the entry into one of said carriages of an occupant for indicating in the other of said carriages to warn an intending occupant that the door means is to be closed.

7. The system according to claim 1 wherein each of the door means comprises a single panel for closing the doorway, a front face of each carriage being open to the single panel at the respectively doorway.

8. The system according to claim 7 wherein the single panel is transparent.

9. The system according to claim 1 including emergency actuable means for releasing each of the door means for manual movement.

10. The system according to claim 1 wherein the first and second doorways and the third and fourth doorways are arranged in pairs in closing adjacent side-by-side relationship such that the door means of each of the doorways when in an open position at least partly overlaps the doorway of the other of the pairs.

11. The system according to claim 1 wherein said support means provides support for supporting both of said carriages, said support means extending from a base on the first floor and extending upwardly from the base so as to transfer vertical forces generated by the weight of the carriages and the occupants downwardly from the support means to the base.

12. The system according to claim 11 wherein the support means comprises a central support structure arranged substantially wholly between the carriages and including cantilever support means for supporting each of the carriages on the central support structure so as to extend outwardly therefrom to a respective side thereof.

13. The system according to claim 12 wherein the central support structure includes a drive shaft and an elongate flexible support element extending from the drive shaft to each of the carriages such that rotation of the drive shaft causes the elongate flexible support element to be driven over the drive shaft longitudinally of its length to move the carriages simultaneously, said drive shaft being mounted at a position below the top of either the first or second carriage when that carriage is on the second floor.

14. The system according to claim 13 wherein the cantilever support means for each of the carriages comprises lower roller means arranged between a lower part of the carriage and the central support structure for preventing movement of the lower part of the carriage toward the central support structure and an upper roller means arranged between a part of the carriage above the lower part and the central support structure and arranged to prevent movement of the upper part of the carriage away from the central support structure.

15. A building and elevator system therein comprising a building having a first storey and a second storey arranged directly above the first storey without intervening storeys, each storey including a floor surface on which an occupant can stand, and an elevator mounted within the building so as to transport occupants from the first storey to the second storey and vice versa, the elevator comprising a first carriage and a second carriage, each carriage being dimensioned to receive at least one erect human occupant, support means mounting each of the first and second carriages for movement only between the first and the second storeys, said support means being arranged such that the carriages are counterbalanced so that one carriage is positioned at the first storey while the other is positioned at the second storey and weight of said one carriage as it moves upwardly from the first storey to the second storey is counterbalanced by the weight of the other carriages as it moves downwardly from the second storey to the first storey, said support means providing support for supporting both of the said carriages, said support means comprising a base mounted on the surface on the first storey, a plurality of support beams extending upwardly from the base, a horizontal drive shaft mounted at the top of the support beams between the carriages and an elongate flexible support element extending from the drive shaft downwardly to each of the carriages such that rotation of the drive shaft causes the elongate flexible support element to be driven over the drive shaft longitudinally of its length to move the carriages simultaneously, the height of the support beams being below the top of either the first or second carriage when that carriage is on the second storey and above the floor surface of the second storey, and the support beam being arranged so as to transfer substantially all the forces generated by the weight of the carriages and the occupants downwardly along the support beams to the base.

16. The system according to claim 15 wherein the support beams are arranged substantially wholly between the carriages and including cantilever support means for supporting each of the carriages on the support beams so as to extend outwardly therefrom to a respective side thereof.

17. The system according to claim 16 wherein the cantilever support means for each of the carriages comprises lower roller means arranged between a lower part of the carriage and the central support structure for preventing movement of the lower part of the carriage toward the support beams and an upper roller means arranged between a part of the carriage above the lower part and the support beams and arranged to prevent movement of the upper part of the carriage away from the support beams.

* * * * *